US005638680A

United States Patent [19]

Iversen

[11] Patent Number: 5,638,680

[45] Date of Patent: Jun. 17, 1997

[54] DEVICE FOR DOUBLE-ACTING HYDRAULIC SYSTEMS

[75] Inventor: Bjørn Scholz Iversen, Kongsberg, Norway

[73] Assignee: Kongsberg Automotive A/S, Kongsberg, Norway

[21] Appl. No.: 640,858

[22] PCT Filed: Nov. 10, 1994

[86] PCT No.: PCT/NO94/00180

§ 371 Date: May 14, 1996

§ 102(e) Date: May 14, 1996

[87] PCT Pub. No.: WO95/14174

PCT Pub. Date: May 26, 1995

[30] Foreign Application Priority Data

Nov. 19, 1993 [NO] Norway ..... 934206

[51] Int. Cl.[6] ..... F15B 7/10

[52] U.S. Cl. ..... 60/572; 60/571; 60/584

[58] Field of Search ..... 60/571, 572, 584

[56] References Cited

U.S. PATENT DOCUMENTS

| | | | |
|---|---|---|---|
| 2,520,731 | 8/1950 | MacDuff | 60/572 |
| 4,030,560 | 6/1977 | Parquet et al. | 60/571 |
| 4,033,132 | 7/1977 | Priest et al. | 60/584 |
| 4,959,960 | 10/1990 | LaFountain . | |
| 4,979,366 | 12/1990 | Compton et al. . | |

FOREIGN PATENT DOCUMENTS

| | | | |
|---|---|---|---|
| 7123918 | 8/1954 | United Kingdom | 60/572 |
| 1357898 | 6/1974 | United Kingdom | 60/584 |
| WO92/08914 | 5/1992 | WIPO . | |

*Primary Examiner*—F. Daniel Lopez

*Attorney, Agent, or Firm*—Finnegan, Henderson, Farabow, Garrett & Dunner

[57] ABSTRACT

A double acting hydraulic system including a master cylinder and a slave cylinder. Each of two slave cylinder spaces has a nipple boring (12, 22), for a nipple valve (40, 50), with an internal section in a form of a seat (16, 26) cooperating with an end (41, 51) of the nipple valve. A sealing section (19, 29) in each nipple boring located outside the seat slidingly and sealingly abuts a sealing section (44, 54) of the respective nipple valve. There is an annular space between each nipple valve and nipple boring, between the seat and the sealing section; and a connecting channel (35) provides communication between the annular spaces. One of the nipple valves has a nipple channel (60) with one opening (61) into the corresponding annular space and a second opening (62) to outside the nipple boring; and a device (63) that cooperates with the nipple channel to prevent fluid flow from outside the nipple boring to the annular space.

2 Claims, 3 Drawing Sheets

DEVICE FOR DOUBLE-ACTING HYDRAULIC SYSTEMS

The invention relates to a device for double-acting hydraulic systems.

From WO92/08914 it is known that double-acting hydraulic systems can be filled with hydraulic fluid, hereinafter called oil, by first filling one circuit and then the second circuit. In a known type of master cylinder, a channel in the cylinder wall at each piston end section connects the respective cylinder spaces with an oil reservoir via a boring in each piston end section. One end of this boring leads into the piston surface between two packings which are located at each piston end section, and in the boring there is provided a one-way valve which prevents flow from the cylinder space to the reservoir. Thus oil can flow almost unimpeded from the reservoir to each master cylinder space, but not in the opposite direction. If the latter is to be possible, the piston first has to be moved in one direction until the outermost packing at the piston end where the volume of the cylinder space increases has passed the channel outlet. The circuit of the double-acting master cylinder/slave cylinder system which comprises this cylinder space can now be filled with oil, the circuit first being evacuated and then connected with an oil reservoir from where the oil is sucked and fills this circuit.

Thereafter the master cylinder's piston can be moved the other way until the outermost packing at the second piston end section uncovers the second boring in the cylinder, whereupon the second circuit is first evacuated and then filled with oil in a similar manner.

In this method the same steps have to be repeated, which is cumbersome and time-consuming. Moreover the oil which has been sucked into the supply line to the evacuation coupling will be able to create difficulties during the evacuation of the second circuit.

Alternatively the system can be filled by means of oil under pressure. In this method the vent valves on the slave cylinder are first opened and oil supplied to the circuits via associated channels in the master cylinder. Oil flows hereby through the associated communicating borings in the piston and one-way valves in these, and into the associated slave cylinder space, the air in the circuits escaping through the vent valves. When oil flows out of the vent valve, this is closed.

This method too is cumbersome and time-consuming, and has the additional problem of oil spillage. This method is also unreliable in systems where there are a great many bends in the pipes and the pipe diameter is large.

Within the car industry, e.g., simpler and better methods are being sought whereby double-acting hydraulic systems can be filled.

The object of the invention is therefore to provide a device of the type mentioned in the introduction which is not encumbered by the above-mentioned disadvantages.

The invention will now be described in more detail with reference to the drawing which illustrates schematically an embodiment of a device according to the invention.

Figure 1:
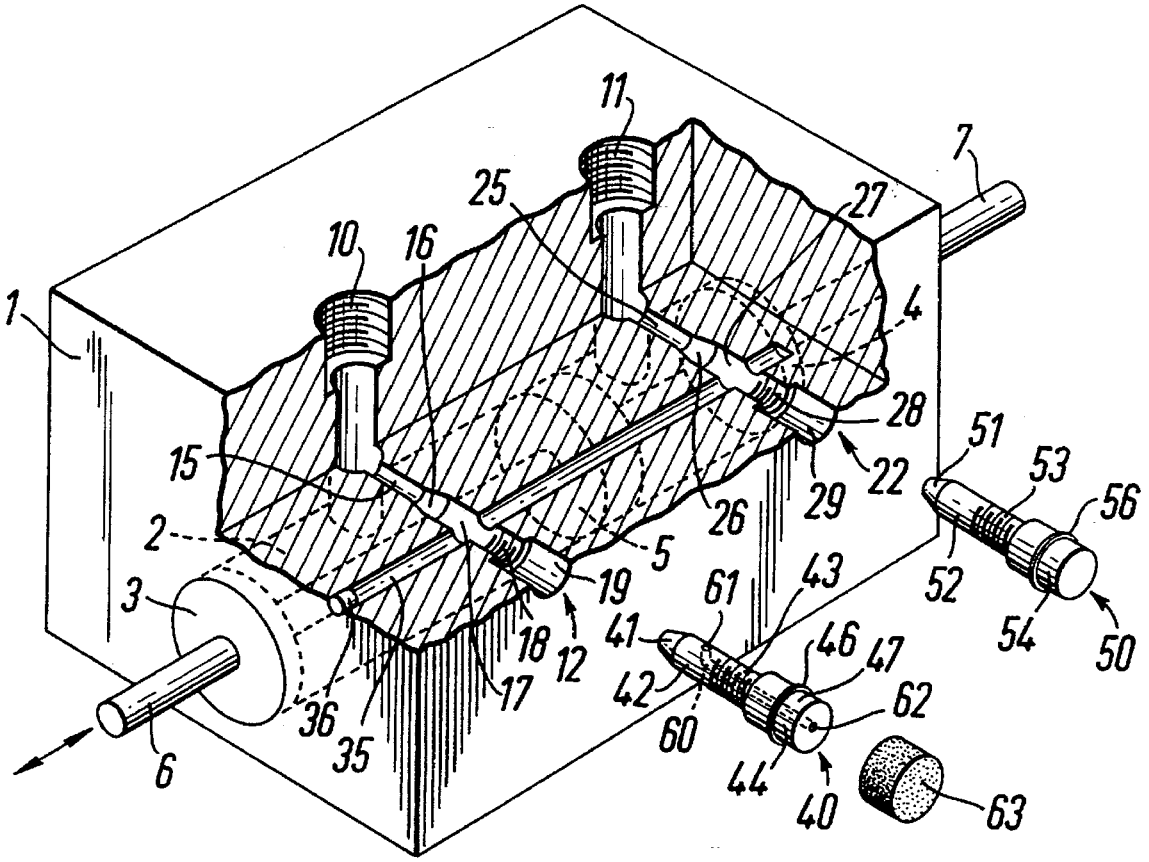
FIG. 1 is a perspective view of a double-acting slave cylinder and channels therein, where sections of the slave cylinder housing have been cut away.

As illustrated in FIG. 1 there extends centrally through a slave cylinder housing 1 a cylinder boring 2, which is closed at each end by respective cylinder end walls 3, 4. In the cylinder boring 2 there is slidably provided a piston 5 whose opposite ends are connected with respective piston rods 6, 7, which sealingly extend through borings in the cylinder end walls 3, 4.

Figure 2:
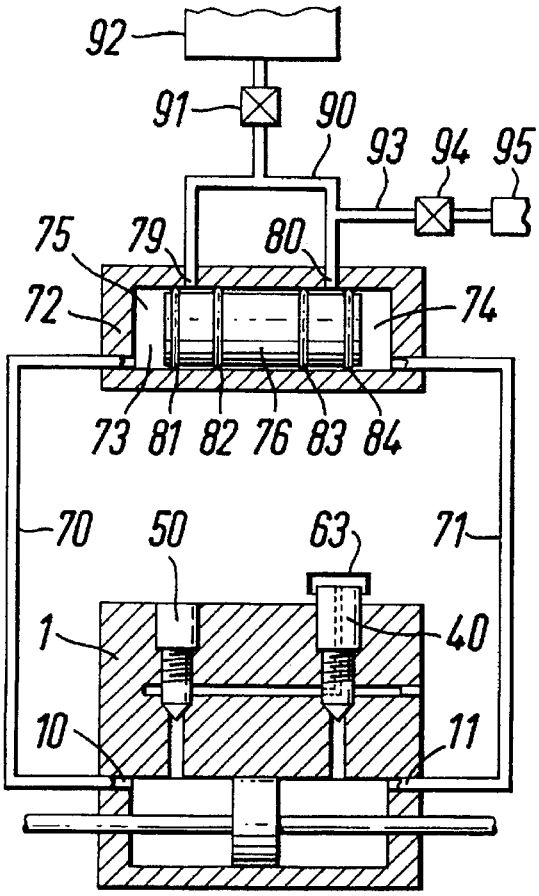
FIGS. 2–5 show simplified longitudinal sections through a double-acting hydraulic system, where some of the components are illustrated in various relative positions in the various views.

According to FIG. 2 pipe lines 70, 71 whereby oil from the associated master cylinder's 72 two cylinder spaces 73, 74 can be supplied to the slave cylinder housing 1, are connected to respective supply borings 10, 11 in the housing 1, end sections of the lines being capable of comprising plugs with external threads and the supply borings can have an external section with corresponding internal threads, thus enabling the lines to be sealingly connected with the housing by screwing the plugs into the outer section of the supply borings.

Across from and communicating with the supply borings 10, 11 there extends a first and a second nipple boring 12 and 22 respectively which lead into one side of the housing 1. These nipple borings can comprise a number of mutually coaxial sections. Thus a first cylindrical section 15, 25 is connected via a cone section or seat 16, 26 to the internal end of a second cylindrical section 17, 27, the diameter of the first cylindrical section 15, 25 corresponding to the diameter of the small end of the cone section 16, 26, and the diameter of the second cylindrical section corresponding to the diameter of the large end of the cone section 16, 26. The external end of the second cylindrical section 17, 27 is connected to a third cylindrical section 18, 28 which is provided with internal threads whose inner diameter corresponds to the diameter of the second cylindrical section. In its turn the external end of the third cylindrical section 18, 28 is connected to the internal end of a fourth cylindrical section 19, 29 with a larger diameter than the third cylindrical section 18, 28.

A blind connecting channel 35 whose initially open end is sealed with a plug 36, extends parallel to the cylinder boring 2 and across the nipple borings 12, 13 and communicates with their second sections 17, 27.

A first and a second vent nipple 40 and 50 respectively are arranged to be screwed into the respective nipple borings 12, 22. In the following description of these nipples, the end thereof which is arranged to be first inserted into the nipple boring 12, 22 will be described as the internal end of the nipple.

The internal end section of the nipples is in the form of a cone section 41, 51, whose outer end is connected to a second cylindrical nipple section 42, 52. The outer end of this second nipple section 42, 52 is connected to a third cylindrical section 43, 53 with external threads, the diameter of the second nipple section being smaller than the inner diameter of the thread of the third section.

The outer end of the third cylindrical section 43, 53 is connected to a fourth cylindrical section 44, 54 whose diameter is larger than the diameter of the third cylindrical section.

In a circumferential groove which is formed in the fourth cylindrical nipple section there is inserted a packing 46, 56 which is arranged for slidable abutment against the fourth cylindrical nipple boring section and to seal the annular gap between these sections when the third, threaded sections 43, 53 of the nipples 40, 41 are in threaded engagement with the respective third, threaded sections 18, 28 of the nipple borings 12, 22. The fourth cylindrical section of the first nipple 40 is so long that an outer section 47 thereof projects out of the housing 1 in the case of such a threaded engagement.

In the first nipple 40 there is formed a through-going nipple channel 60 whose internal end leads on to the surface of the second cylindrical section 42, and whose external end leads on to the outer end of the nipple, as indicated by the reference numbers 61 and 62 respectively.

When the nipples 40, 50 are completely screwed into the nipple borings 12, 22, the nipples' cone section 41, 51 abuts sealingly against the respective cone sections or seats 16, 26 of the nipple borings 12, 22.

When the nipples are slightly unscrewed from this sealing position, oil or air can flow from the cylinder boring 2 to the connecting channel 35 and vice versa via the conical gap between the cone sections. From the connecting channel 35 fluid can flow on into the first nipple's channel 60 and out through its outer opening 62.

A hood 63 made of, e.g., rubber, is arranged to be pulled over the outer end section 47 of the first nipple 40. The hood's central section is arranged to be brought to sealing abutment around the nipple channel's external outlet when the pressure in the channel is less than the pressure of the surrounding air. Thus it can function as a one-way valve.

In FIGS. 2–5 there is illustrated a hydraulic system with a double-acting master cylinder 72 and a slave cylinder similar to that described above in connection with FIG. 1, and where corresponding components are provided with the same reference numbers. In connection with these figures it should be understood that the indications of directions right and left refer to the respective directions in the figures in relation to the reader.

As illustrated in FIGS. 2–5, in the master cylinder's cylinder boring 75 there is provided a piston 76 which by means of a movement device (not shown) can be moved forwards and backwards in the cylinder boring 75. At each end section of the piston 76 there are provided in a groove therein two circumferential packings 81, 82 and 83, 84 respectively, e.g. lip seals, whose lips face towards the cylinder wall and towards the end of the respective end section of the piston 76.

Through the cylinder wall there extend two channels 79, 80 which lead into the cylinder boring 75 between the packings 81, 82, 83, 84 of the respective end sections of the piston 76. The distance between the packings in the pairs of packings at each end is so great that the respective channels 79, 80 are always located between these packings at maximum stroke of the piston 76 during normal operation of the system. However, the said movement device for the piston 76 is arranged to move it so far to each side to an extreme right or left position that the outermost packing, i.e. that packing in each pair which is located closest to the respective piston end, is moved past the outlet of the associated channel 79, 80, thus enabling the relevant channel 79, 80 to communicate with the adjacent cylinder space unimpeded by the external packing.

The channels 79, 80 are connected via lines 90 and a vane 91 with a reservoir 92 for oil, and a line 93 which is connected with the lines 90 is connected via a valve 94 with a coupling 95 which can be connected to an evacuation pump (not shown).

The relative positions of the system's components which are illustrated in FIG. 2 are representative of the normal operation of the system.

Figure 3:
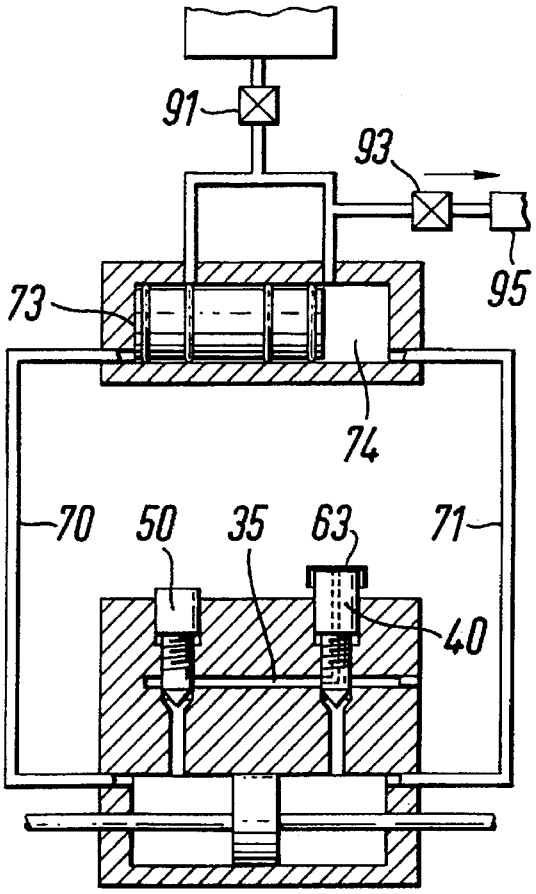

FIG. 3 shows the system being filled with oil by means of the evacuation of the system.

The master cylinders piston 76 is initially brought to, e.g., the left hand, outermost position, the evacuation valve 94 is opened and the vent nipples 40, 50 are slightly unscrewed, while the reservoir valve 91 is closed. Thereafter an evacuation pump is connected by means of the coupling 95. The system is thereby evacuated including the left master cylinder space 73 via the line 70, the left slave cylinder space, the second nipple 50, the connecting channel 35, the first nipple 40, the right slave cylinder space, the line 71, the right master cylinder space 74, the right channel 80 and the line 93. During the evacuation the hood 63 is sucked towards the first nipple 40 and seals the outlet 62 of the nipple channel 60.

Thereafter the evacuation valve 94 is closed and the reservoir valve 91 opened. Oil from the reservoir is then sucked from this and very rapidly fills the entire system in the opposite direction to that which was described during the evacuation and in addition via the borings in the master cylinder's end sections. As soon as the system is filled, the master cylinder's piston 76 is brought back from its outermost position, whereupon the nipples 40, 50 are closed.

Figure 4:
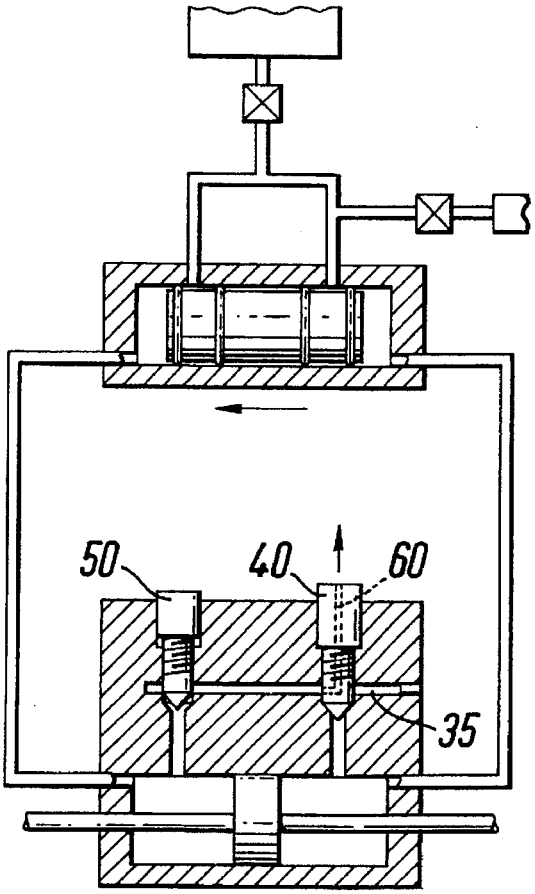

FIG. 4 shows the relative positions of the components during venting (bleeding) of the system's left circuit after it has been filled.

The second, left hand nipple 50 is hereby opened slightly, thus allowing the left circuit to communicate with the connecting channel 35.

During movement of the master cylinder's piston towards the left, aerated oil can thereby be forced out through the first nipple's channel 60.

Figure 5:
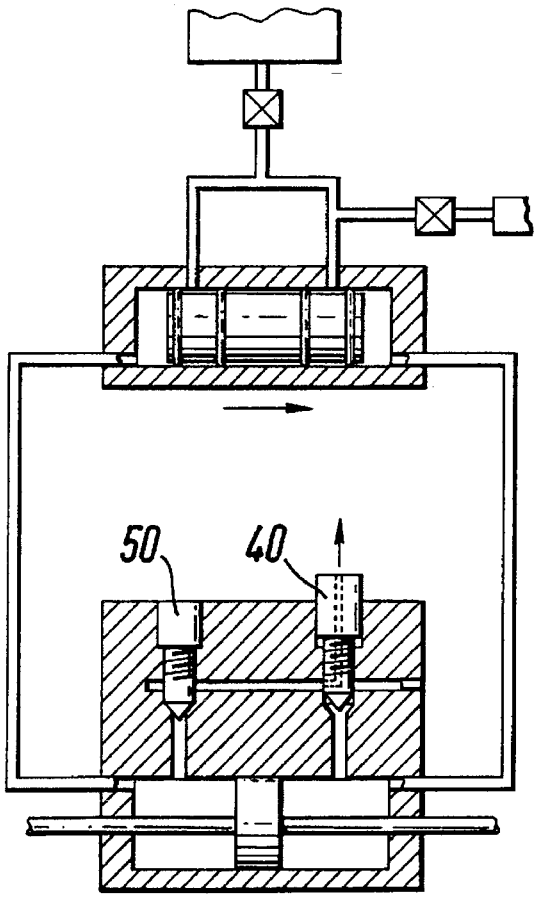

FIG. 5 shows the relative positions of the components during venting of the system's right circuit.

The second, left vent nipple is hereby closed and the first nipple 40 is slightly opened. During movement of the master cylinders piston 76 to the right, aerated oil is forced into the connecting channel via the opened cone section 16, and from there into the nipple channel 60 and out.

Thus by means of the invention a simple device has been provided for filling the entire two-circuit system in one operation during e.g. the production of cam, while at the same time the nipples employed here can be used for venting the circuits in approximately the same manner as previously during the maintenance of the system.

I claim:

1. A double-acting hydraulic system with a master cylinder (72) and a slave cylinder (1), each having a piston and two cylinder spaces (73, 74, 2), wherein each master cylinder space (73; 74) is connected to a reservoir (92) for hydraulic fluid and the master cylinder piston (76) can be moved to a position wherein fluid can flow both ways between one of said master cylinder space (73, 74) and the reservoir (92), the slave cylinder (1) has two vent nipple borings (12, 22), each of which communicates with its slave cylinder space, where an internal section (16, 26) of the nipple borings is in the form of a seat against which a first end section (41, 51) of respective vent nipples (40, 50) selectively abuts and closes the nipple borings (12, 22) when the nipples (40, 50) are screwed completely into the nipple borings (12, 22), an annular space exists between each nipple boring (12, 22) and the respective nipples (40, 50) inserted therein, at least one of the nipples (40) having a nipple channel (60), whose one opening (61) is located near the first end section (41) of the nipple (40) and opens into the corresponding annular space, and whose second opening (62) is located at a free end of a second end section (44) of the nipple (40), and the hydraulic system can be alternately coupled to an evacuation device and the reservoir (92), characterized in that a first sealing section (19, 29) of the nipple borings (12, 22), located outside the seat (16, 26), is arranged to slidably and sealingly abut against a second sealing section (44, 54) of the nipples (40, 50) both when the first end section (41, 51) of these closes and opens the nipple boring (12, 22), that a connecting channel (35) provides communication between the annular spaces in each nipple boring (12, 22) in the area between the seat (16, 26) and the first sealing section (19, 29) of the nipple boring, and that there cooperates with the nipple channel (60) a device (63) which prevents fluid flow in the channel (80) from the second end section of the nipple towards the first.

2. A double acting hydraulic system according to claim 1, characterized in that in the second sealing section (44, 45) of the nipples (12, 22) there is formed a circumferential groove, wherein there is provided a ring seal (46, 56), and that the first sealing section (19, 29) of the nipple borings (12, 22) is cylindrical and has a surface against which the packing (46) can slidably and sealingly abut.

* * * * *

UNITED STATES PATENT AND TRADEMARK OFFICE

CERTIFICATE OF CORRECTION

PATENT NO. : 5,638,680
DATED : June 17, 1997
INVENTOR(S) : Bjørn Scholz Iversen

It is certified that error appears in the above-indentified patent and that said Letters Patent is hereby corrected as shown below:

Claim 1, column 4, line 45, "space" should read --spaces--;

line 51, before "abuts", inset --sealingly--.

Signed and Sealed this

Seventeenth Day of February, 1998

*Attest:*

*Attesting Officer*

BRUCE LEHMAN

*Commissioner of Patents and Trademarks*